US008783676B2

(12) United States Patent
Yamamoto

(10) Patent No.: US 8,783,676 B2
(45) Date of Patent: Jul. 22, 2014

(54) SHEET FEEDING UNIT AND IMAGE FORMING APPARATUS

(71) Applicant: Canon Kabushiki Kaisha, Tokyo (JP)

(72) Inventor: Daisuke Yamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/777,710

(22) Filed: Feb. 26, 2013

(65) Prior Publication Data

US 2013/0221603 A1 Aug. 29, 2013

(30) Foreign Application Priority Data

Feb. 29, 2012 (JP) ..... 2012-044511

(51) Int. Cl.
*B65H 3/06* (2006.01)

(52) U.S. Cl.
USPC ..... 271/116; 271/119; 271/114; 271/110; 271/10.13; 271/10.11

(58) Field of Classification Search
USPC ..... 271/4.01, 10.01, 10.04, 10.05, 10.09, 271/10.11, 10.13, 10.12, 113, 114, 116, 119
See application file for complete search history.

(56) References Cited

U.S. PATENT DOCUMENTS

| | | | | |
|---|---|---|---|---|
| 5,722,654 | A * | 3/1998 | Sootome et al. | 271/119 |
| 7,357,387 | B2 * | 4/2008 | Asada | 271/110 |
| 7,770,881 | B2 * | 8/2010 | Yokemura et al. | 271/10.13 |
| 2010/0156029 | A1 * | 6/2010 | Kwak et al. | 271/10.13 |
| 2011/0024968 | A1 * | 2/2011 | Ichikawa et al. | 271/10.11 |

FOREIGN PATENT DOCUMENTS

JP 01-92148 A 4/1989

* cited by examiner

*Primary Examiner* — Luis A Gonzalez
(74) *Attorney, Agent, or Firm* — Canon USA Inc IP Division

(57) ABSTRACT

A feeding roller, a drive motor configured to drive the feeding roller, a control unit configured to perform one rotation control on the feeding roller, a sheet feeding path curved immediately after the feeding roller, a conveying roller pair provided in the sheet feeding path, and being set to a sheet conveyance speed higher than that of the feeding roller so as to eliminate a loop formed when a sheet passes through the sheet feeding path during one rotation control of the feeding roller; and a ratchet mechanism configured to stop the driving force from the drive motor and cause the feeding roller to be rotated by the sheet conveyed by the conveying roller pair when the feeding roller is pulled by the sheet being conveyed by the conveying roller pair in the course of the one rotation control of the feeding roller are provided.

5 Claims, 12 Drawing Sheets

SHEET FEEDING UNIT AND IMAGE FORMING APPARATUS

BACKGROUND OF THE INVENTION

1. Field of the Invention

The present disclosure relates to a sheet feeding unit and an image forming apparatus provided with the sheet feeding device and, specifically, to a sheet feeding unit configured to feed sheet separately one by one and an image forming apparatus provided with such a sheet feeding unit.

2. Description of the Related Art

In the related art, image forming apparatuses such as printers, facsimiles, and copying machines configured to store sheets in a feeding cassette demountably mounted on an apparatus body and feed the sheets stored in the feeding cassette separately one by one to an image forming apparatus when forming images are known.

Recently, image forming apparatuses which are reduced in size by bending a sheet feeding path for sheets fed from a feeding cassette significantly upward and feeding the sheets to an image forming unit positioned downstream of the sheet feeding path are proposed. For example, such a technology is disclosed in Japanese Patent Laid-Open No. 01-92148.

In the image forming apparatus configured as described above, separating system such as a separation pad method or a retard method are employed, and a feeding method on the basis of so-called one rotation control, which is control to feed a sheet by a 360-degree rotation of a feeding roller, is employed. In this control, a sheet feeding speed Vp of the feeding roller is set to be higher than a sheet conveyance speed Vf of a conveying roller located downstream. The reason is that if the paper feeding speed of the feeding roller is set to be lower than the sheet conveyance speed of the conveying roller, the feeding roller is pulled by a sheet conveyed by the conveying roller and hence a load is applied to the feeding roller and the conveying roller, so that uneven abrasion on the surfaces of the rollers may result.

When the sheet feeding path is bent significantly upward, a leading edge of the sheet fed from the feeding cassette abuts against the sheet feeding path, and the sheet undergoes a deflection and forms a loop. If the sheet is conveyed by the conveying roller in this state, the loop of the sheet in the sheet feeding path is not eliminated and is further increased because the sheet conveyance speed of the conveying roller is lower than the feeding speed of the feeding roller. If the one rotation control of the feeding roller is employed here, a backward tension is applied from the sheet to the conveying roller and the loop of the sheet in the sheet feeding path is abruptly eliminated when feeding of the sheet by the feeding roller is finished in the state in which the sheet forms the loop. Accordingly, the deflected sheet is pulled and such pulling of the sheet generates a sound.

SUMMARY OF THE INVENTION

The invention at least provides a sheet feeding unit capable of reducing a burst sound generated when one rotation control of a feeding roller is finished while preventing uneven abrasion of the feeding roller and a conveying roller, and an image forming apparatus provided with such a sheet feeding apparatus.

The disclosure provides a sheet feeding unit including: a feeding roller configured to feed a sheet; a drive motor configured to drive the feeding roller; a driving force transmission mechanism configured to transmit a driving force from the drive motor to the feeding roller; a one rotation control mechanism configured to control the rotation of the feeding roller; a curved sheet feeding path provided downstream of the feeding roller in the sheet feeding direction; a conveying roller provided in the sheet feeding path, being set to a sheet conveyance speed higher than that of the feeding roller so as to eliminate a loop formed when the sheet fed by the feeding roller when passing through the sheet feeding path during one rotation control of the feeding roller, and configured to receive the sheet fed from the feeding roller and conveying the received sheet; and a one-way rotation control mechanism configured to stop the driving force from the drive motor and cause the feeding roller to be rotated by the sheet conveyed by the conveying roller when the feeding roller is pulled by the sheet being conveyed by the conveying roller in the course of the one rotation control of the feeding roller.

Further features of the present invention will become apparent from the following description of exemplary embodiments with reference to the attached drawings.

DESCRIPTION OF THE EMBODIMENTS

Figure 1:
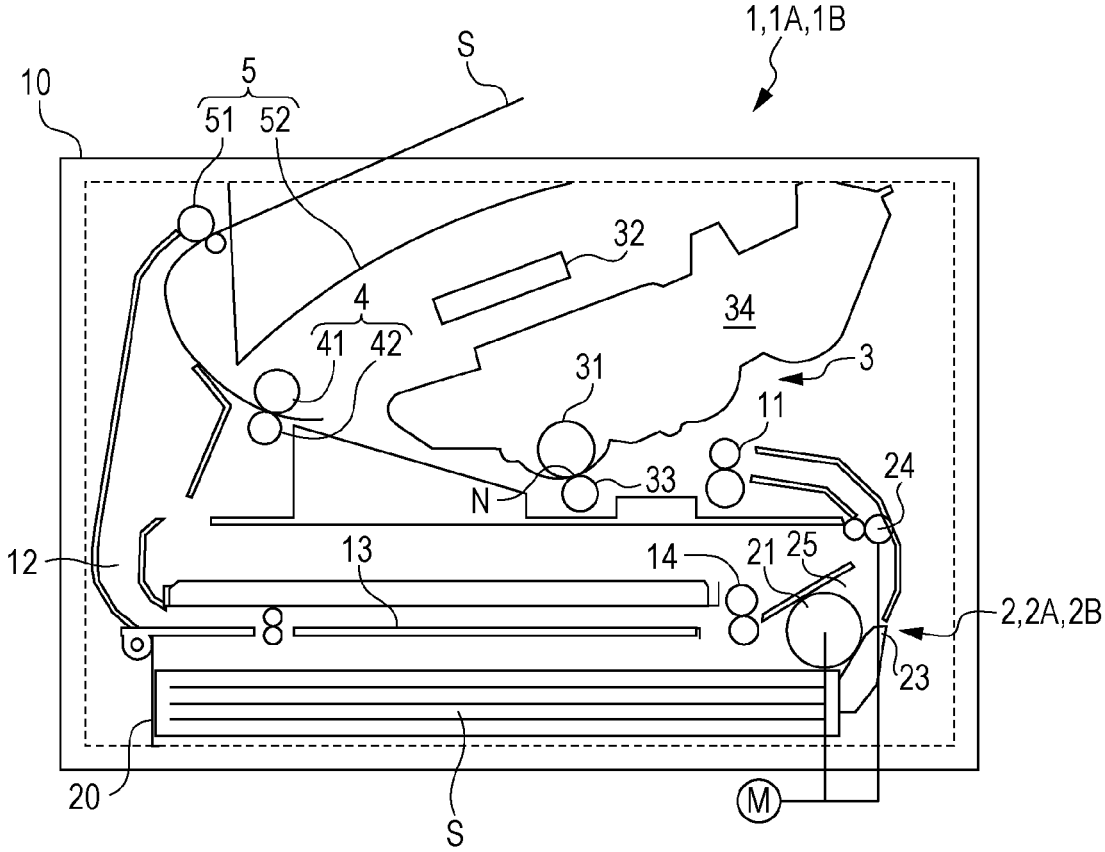
FIG. 1 is a schematic cross-sectional view illustrating a general structure of a laser printer of a first embodiment.

Referring now to the drawings, an image forming apparatus provided with a sheet feeding unit according to embodiments disclosed herein will be described. The image forming apparatus of the embodiments of the disclosure is an image forming apparatus such as a copying machine, a printer, a facsimile, and a composite machine thereof provided with a sheet feeding unit capable of supplying sheets separately one by one. In the following embodiments, description is given using a laser beam printer (hereinafter, referred to simply as "laser printer") as an image forming apparatus.

First Embodiment

Referring now to FIG. 1 to FIG. 7, a laser printer according to a first embodiment will be described. First of all, a general structure of the laser printer 1 of the first embodiment will be described with reference to FIG. 1. FIG. 1 is a schematic cross-sectional view illustrating the general structure of the laser printer 1 of the first embodiment.

As illustrated in FIG. 1, the laser printer 1 of the first embodiment includes a sheet feeding unit 2 configured to feed a sheet S, an image forming unit 3 configured to form an image on the sheet S, a fixing unit 4 configured to fix the image on the sheet S, and a discharging portion 5 configured to discharge the sheet S on which the image is fixed. The sheet feeding unit 2 is provided under the laser printer 1, and is configured to supply sheets to the image forming unit 3 while separating the sheets one by one. The sheet feeding unit 2 will be described in detail later.

The image forming unit 3 is provided downstream of the sheet feeding unit 2 in the sheet feeding direction (hereinafter, referred to simply as "downstream"), and includes a photosensitive drum 31 configured to form a toner image and a charger, not illustrated, configured to charge the surface of the photosensitive drum 31 evenly. The image forming unit 3 also includes an exposure unit 32 configured to form an electrostatic latent image on the photosensitive drum 31 by irradiating a laser beam, a developing unit, not illustrated, configured to visualize the electrostatic latent image on the photosensitive drum 31 as a toner image, and a cleaning unit, not illustrated, configured to collect residual toner. Furthermore, the image forming unit 3 includes a transfer roller 33 configured to form a transfer nip N by coming into press contact with the photosensitive drum 31. In this embodiment, the photosensitive drum 31, the charger, the developing unit, and the cleaning unit are unitized, and are configured as a process cartridge 34 so as to be demountably mountable with respect to a printer body 10.

The fixing unit 4 is provided downstream of the image forming unit 3 in the sheet conveying direction (hereinafter, referred to simply as "downstream), and includes a fixing roller 41 including a heater integrated therein and a pressing roller 42 in press contact with the fixing roller 41. The discharging portion 5 is provided downstream of the fixing unit 4 and includes a discharge roller pair 51 configured to discharge the sheets from the interior of the apparatus body and a discharge tray 52 configure to receive the discharged sheets in a stacked manner.

Subsequently, an image forming process performed by the laser printer 1 configured as described above will be described. When the image forming process is started, the exposure unit 32 irradiates the surface of the photosensitive drum 31 with a laser beam in response to an image information signal sent from a personal computer or a scanner, not illustrated. Accordingly, the surface of the photosensitive drum 31 charged evenly at a potential of a predetermined polarity by the charger is exposed, and an electrostatic latent image is formed on the surface of the photosensitive drum 31. When the electrostatic latent image is formed on the surface of the photosensitive drum 31, the developing unit develops the electrostatic latent image with the toner, so that the electrostatic latent image is visualized as a toner image.

In parallel to a toner image forming action performed by the above-described image forming unit, the sheets S are separated one by one and fed by the sheet feeding unit 2. Then, the sheets S fed by the sheet feeding unit 2 are conveyed to the transfer nip N by a registration roller pair 11 arranged downstream of the sheet feeding unit 2 at a predetermined timing. The visualized toner image is transferred to the sheet conveyed to the transfer nip N by the transfer roller 33.

The sheet S to which the toner image is transferred is conveyed from the transfer nip N to the fixing unit 4, and the toner is melt and mixed in color upon reception of heat and pressure by the fixing roller 41 and the pressing roller 42, and fixed as an image. Subsequently, the sheet on which the image is fixed is discharged to the discharge tray 52 by the discharge roller pair 51, and the image forming process is terminated.

In the case of a two-sided printing mode in which images are formed on both sides of sheets S, the discharge roller pair 51 is rotated reversely, conveys the sheets S to a conveying path for two-sided printing 12 before being discharged by the discharge roller pair 51 so that the sheets S are stored temporarily in an intermediate tray 13 in a stacked manner via the conveying path for two-sided printing 12. The sheets S stacked on the intermediate tray 13 are conveyed to the registration roller pair 11 again by a re-feeding roller pair 14, and are conveyed to the transfer nip N again at a predetermined timing. Subsequently, an image is formed through the same process as a one-side printing, the sheets S are discharged to the discharge tray 52, whereby the image forming process is terminated.

Figure 2:
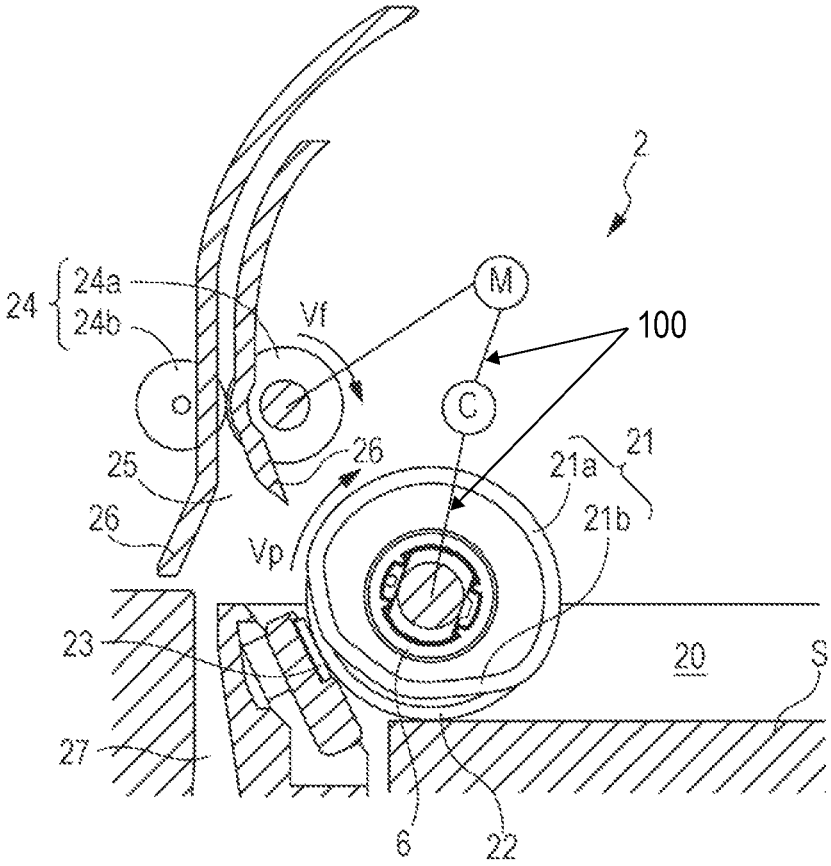
FIG. 2 is a partial enlarged cross-sectional view illustrating a seat feeding unit of the first embodiment.
Figure 3:
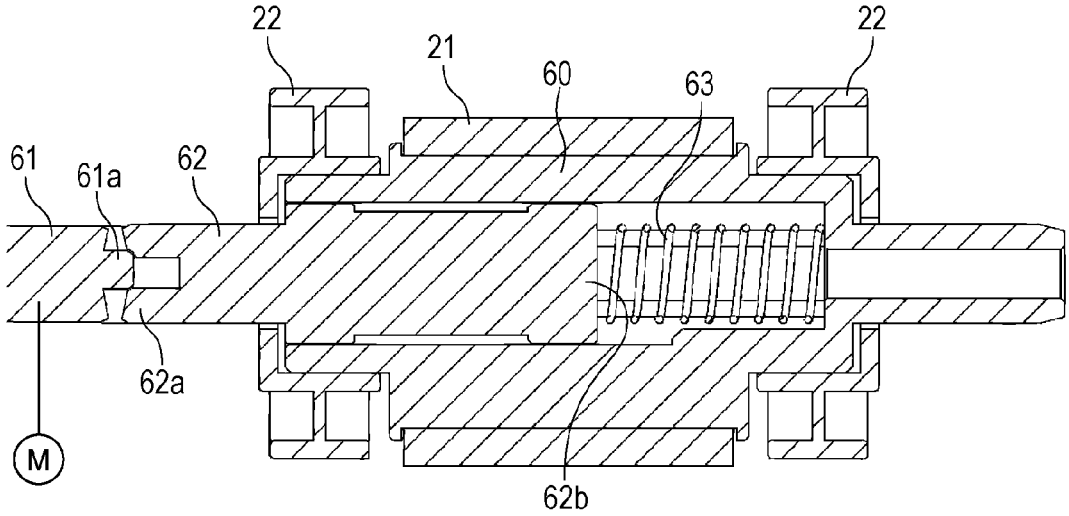
FIG. 3 is a cross-sectional view illustrating a ratchet mechanism of the sheet feeding unit of the first embodiment.
Figure 4A:
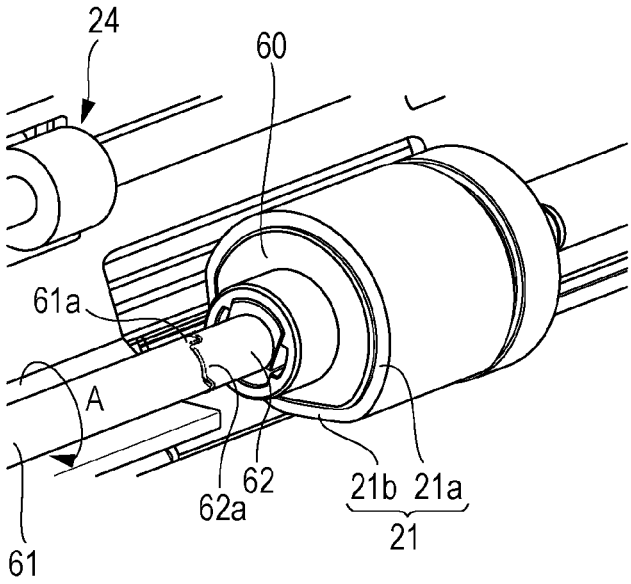
FIG. 4A is a perspective view illustrating a state in which a driving force is transmitted to a feeding roller.
Figure 4B:
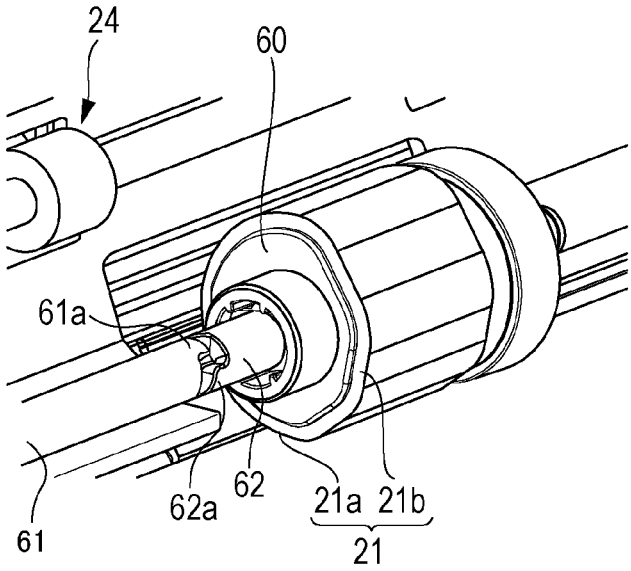
FIG. 4B is a perspective view illustrating a state in which transmission of the driving force to the feeding roller is stopped.

Subsequently, the sheet feeding unit 2 of the first embodiment will be described with reference to FIG. 2 to FIG. 7. First of all, a configuration of the sheet feeding unit 2 will be described with reference to FIG. 1 to FIG. 4B. FIG. 2 is a partial enlarged cross-sectional view illustrating the seat feeding unit 2 of the first embodiment. FIG. 3 is a cross-sectional view illustrating a ratchet mechanism 6 of the sheet feeding unit 2 of the first embodiment. FIG. 4A is a perspective view illustrating a state in which a driving force is transmitted to a feeding roller 21. FIG. 4B is a perspective view illustrating a state in which transmission of a driving force to the feeding roller 21 is stopped.

As illustrated in FIG. 1 and FIG. 2, the sheet feeding unit 2 includes a feeding cassette 20 in which the sheets S are stored, the feeding roller 21 configured to feed the sheets S stored in the feeding cassette 20, and a drive motor M configured to rotate the feeding roller 21. The feeding roller 21 receives a driving force transmitted from the drive motor M via a driving force transmission mechanism 100 composed of gears and the like, and is controlled to feed one sheet with a 360-degree rotation by a one rotation control mechanism C, described later, provided in the driving force transmission mechanism 100. The sheet feeding unit 2 includes feeding rollers 22 disposed coaxially with the feeding roller 21, a separation pad 23 configured to separate the sheets S fed by the feeding roller 21 one by one, and a conveying roller pair 24 configured to convey the sheets S fed by the feeding roller 21.

The feeding cassette 20 is configured to be demountably mountable with respect to the printer body 10. For example, when the last sheet S in the feeding cassette 20 is gone, the sheets S are drawn from the printer body 10 and are refilled. The feeding cassette 20 includes an elevating mechanism, not illustrated, for moving the stored sheets S upward and downward, and the elevating mechanism moves the sheets S stored in the feeding cassette 20 upward so that the upper most sheet comes into press contact with the feeding roller 21.

The feeding roller 21 is formed into a non-circular shape including an arcuate portion 21*a* configured to abut against the sheet S and feed the sheet S, and a notched portion 21*b* formed by cutting out part of the arcuate portion 21*a*. The arcuate portion 21*a* is formed of a resilient member such as rubber having a high friction coefficient. The feeding roller 21 is rotatably supported by the printer body 10 above a downstream end portion of the feeding cassette 20, and the drive motor M is subjected to one rotation control by the one rotation control mechanism C provided in the driving force transmission mechanism 100. The one rotation control mechanism C repeats rotation and stop with every 360-degree rotation of the feeding roller 21, for example, by a clutch mechanism such as a one rotation clutch using a solenoid and missing teeth or an electromagnetic clutch. The drive motor M is coupled to the feeding roller 21 and the conveying roller pair 24 via the driving force transmission mechanism 100 so as to transmit the driving force, and is configured to be capable of driving the feeding roller 21 and the conveying roller pair 24.

The feeding rollers 22 are formed to have the substantially same diameter as the arcuate portion 21*a* of the feeding roller 21, and are disposed on both sides of the feeding roller 21 coaxially (on both sides) with the feeding roller 21. The feeding roller 22 is formed of a synthetic resin or the like having a low friction coefficient. The feeding roller 22 is supported to be rotated by the sheets S being fed. The separation pad 23 is provided at the downstream end portion of the feeding cassette 20, and forms a nip by coming into press contact with the arcuate portion 21*a* of the feeding roller 21 and the feeding roller 22. The separation pad 23 and a conveying guide 26 constitute a sheet feeding path 25. The sheet feeding path 25 is curved at a position immediately after the feeding roller 21 so as to cause the sheets S fed by the feeding roller 21 to be fed upward. The sheet feeding path 25 is bent by the separation pad 23 upward from the downstream end portion of the feeding cassette 20, and then is guided toward the conveying roller pair 24 by the conveying guide 26. In this embodiment, a conveying path 27 from an option feeder, not illustrated, which is to be mounted under the laser printer 1, joins together with the sheet feeding path 25.

The conveying roller pair 24 is disposed downstream of the sheet feeding path 25, and includes a conveying roller 24*a* which is rotated by the driving force of the drive motor M transmitted thereto and a drive roller 24*b* brought into a press contact with the conveying roller 24*a*. The conveying roller pair 24 is set to be a sheet conveyance speed Vf which is higher than a sheet feeding speed Vp of the sheets S (Vf>Vp) by the feeding roller 21, and this speed relationship is set to cause the feeding roller 21 to eliminate a loop of the sheet S during the one rotation control. In this embodiment, the speed relationship is set so that the loop of the sheet S is eliminated before the arcuate portion 21*a* of the feeding roller 21 abuts against the sheet and the arcuate portion 21*a* leaves the sheet (the feeding is terminated). The setting of a sheet conveyance speed difference between the feeding roller 21 and the conveying roller pair 24 is achieved by a general mechanism. For example, the number of revolutions (circumferential velocity) of the feeding roller 21 is set on the basis of a gear ratio of the driving force transmission mechanism 100 which transmits the rotation from the drive motor M to the feeding roller 21, and the number of revolutions (circumferential velocity) of the conveying roller 24*a* is set on the basis of a gear ratio of the driving force transmission mechanism 100 which transmits the rotation from the drive motor M to the conveying roller 24*a*. Then, the numbers of revolutions (circumferential velocities) of the feeding roller 21 and the conveying roller 24*a* are set so that the sheet conveyance speed difference between the feeding roller 21 and the conveying roller pair 24 becomes a desired value. As another example, the sheet conveyance speed difference between the feeding roller 21 and the conveying roller pair 24 are set to be a desired value on the basis of the number of revolutions transmitted from the drive motor M and the diameters of the feeding roller 21 and the conveying roller pair 24.

The ratchet mechanism 6 is interposed between the feeding roller 21 and a drive shaft 61, and when the feeding roller 21 to be subjected to the one rotation control is pulled by the sheet S, the transmission of the driving force of the drive motor M is stopped and the feeding roller 21 is caused to be rotated by the sheet S being conveyed.

As illustrated in FIG. 2 and FIG. 3, the ratchet mechanism 6 is disposed coaxially with the feeding roller 21 in the interior of the feeding roller 21. As illustrated in FIG. 3, the ratchet mechanism 6 includes a feeding roller core 60, the drive shaft 61 connected to the drive motor M, a shaft 62 capable of being coupled to the drive shaft 61, and an urged spring 63 as an urging device for urging the shaft 62 toward the drive shaft 61.

The feeding roller core 60 fixedly supports the feeding roller 21 and is rotatably supported by the printer body 10, whereby the feeding roller 21 is rotatably supported by the printer body 10. The feeding roller core 60 rotatably supports the feeding rollers 22 disposed on the both sides of the feeding roller 21.

The drive shaft 61 is connected at one end portion thereof to the drive motor M via the driving force transmission mechanism 100, and is formed at the other end portion thereof with an engaging portion 61*a* which is engageable with an engaged portion 62*a*, described later, formed at one end portion of the shaft 62. As illustrated in FIG. 4A, the engaging portion 61*a* engages the engaged portion 62*a* when the drive shaft 61 rotates in a direction of feeding rotation A and rotates the shaft 62 in the direction of feeding rotation A.

The shaft 62 is disposed coaxially with the feeding roller 21 in the interior of the feeding roller core 60. The shaft 62 is formed at one end portion thereof with the engaged portion 62*a*, and at the other end thereof with urged portion 62*b* urged by the urged spring 63. The engaged portion 62*a* is configured to be disengaged from the engaging portion 61*a*, for example, when the feeding roller 21 is pulled by the sheet S and the shaft 62 rotates in the direction of feeding rotation A at an angular rotational speed higher than that of the rotated drive shaft 61. In other words, when the driving force from the drive motor M is transmitted and the drive shaft 61 is rotated in the direction of feeding rotation A, the drive shaft 61 and the shaft 62 are coupled to be driven. When the shaft 62 is rotated in the direction of feeding rotation A at an angular rotational speed higher than that of the drive shaft 61, the coupling to transmit the driving force between the drive shaft 61 and the shaft 62 is released. The shapes of the engaging portion 61*a* and the engaged portion 62*a* will be described. The engaging portion 61*a* and the engaged portion 62*a* are formed in such a manner that flat surfaces which extend from a peripheral surfaces toward an axial center formed on the drive shaft 61 and the shaft 62 respectively abut against each other in the circumferential direction when the drive shaft 61 is rotated and the rotation is transmitted to the shaft 62. Also, the engaging portion 61*a* and the engaged portion 62*a* are formed in such a manner that when the shaft 62 rotates at an angular rotational speed higher than that of the drive shaft 61, the engaging portion 61*a* and the engaged portion 62*a* abut against each other via inclined surfaces thereof so that the shaft 62 moves away from the drive shaft 61 in the axial direction when the shaft 62 is rotated relatively faster than the earth wire connecting portion 61.

The urged spring 63 is disposed in the interior of the feeding roller core 60, and urges the shaft 62 toward the drive shaft 61, so that the engaging portion 61*a* and the engaged portion

62*a* are engaged when the phases of the engaging portion 61*a* and the engaged portion 62*a* match. An urging force of the urged spring 63 is set to an urging force which allows disengagement between the engaging portion 61*a* and the engaged portion 62*a* when the feeding roller 21 is pulled by the sheet S and the shaft 62 rotates in the direction of feeding rotation A at an angular rotational speed higher than that of the drive shaft 61.

Figure 5:
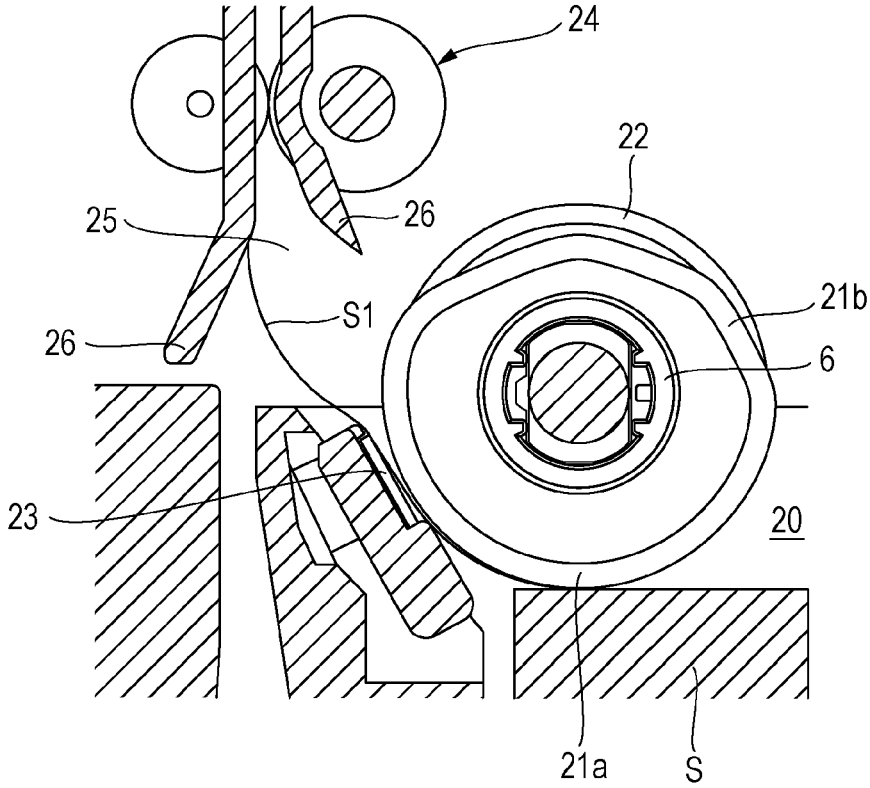
FIG. 5 is a cross-sectional view illustrating a state in which a sheet fed by the feeding roller forms a loop.
Figure 6:
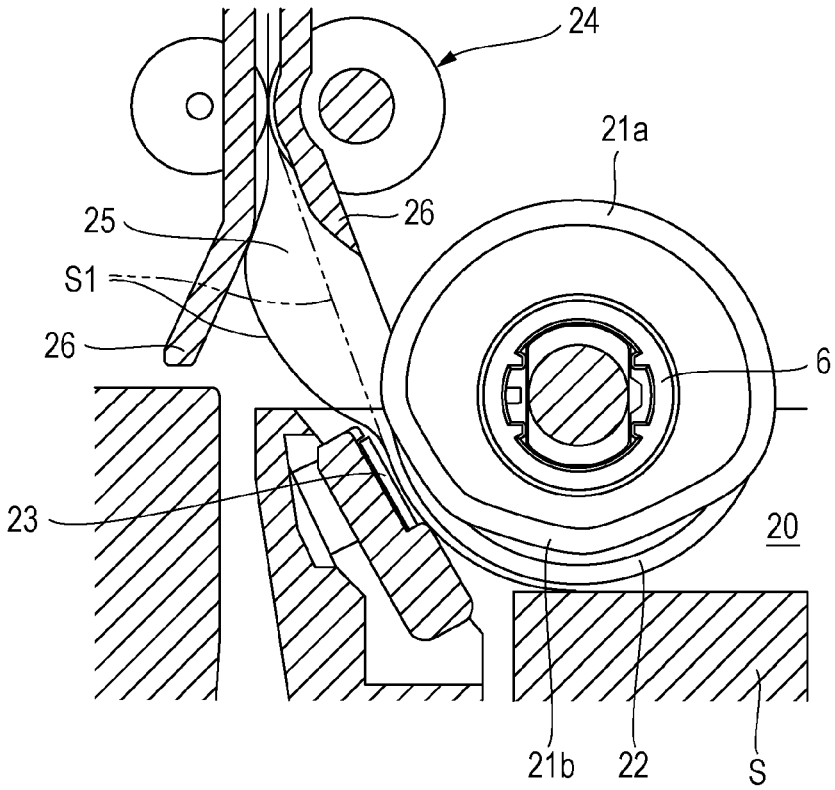
FIG. 6 is a cross-sectional view illustrating a state in which the sheet forming the loop is conveyed by a conveying roller.
Figure 7:
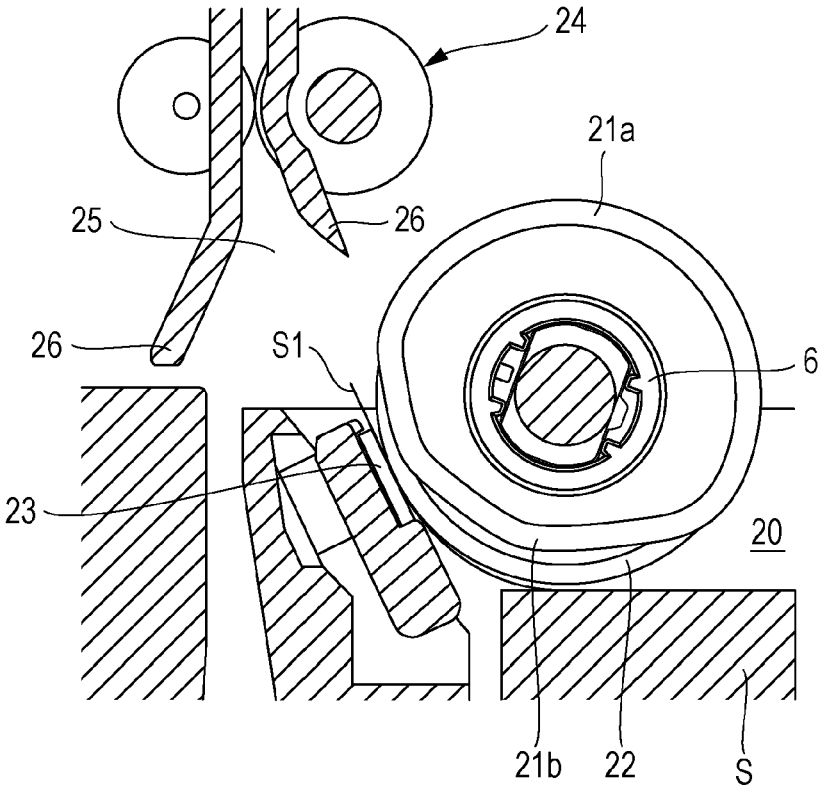
FIG. 7 is a cross-sectional view illustrating a state in which a sheet is held in a nip between a feeding roller and a separation pad.

Subsequently, a sheet feeding operation performed by the sheet feeding unit 2 of the first embodiment will be described with reference to FIG. 5 to FIG. 7. FIG. 5 is a cross-sectional view illustrating a state in which a sheet S fed by the feeding roller 21 forms a loop. FIG. 6 is a cross-sectional view illustrating a state in which the sheet S forming the loop is conveyed by the conveying roller pair 24. FIG. 7 is a cross-sectional view illustrating a state in which the sheet S is held in a nip between feeding rollers 22 and the separation pad 23.

When the feeding of the sheet S by the sheet feeding unit 2 is started in parallel to the toner image forming action in the image forming unit described above, the elevating mechanism of the feeding cassette 20 moves the sheet S stored in the feeding cassette 20 upward, and brings an uppermost sheet S1 to abut against the arcuate portion 21*a* of the feeding roller 21. The arcuate portion 21*a* of the feeding roller 21 waits at a predetermined home position when the feeding of the sheet S is started. When the rotation control of the drive motor M by a control unit is started and the one rotation control of the feeding roller 21 is started by the one rotation control mechanism C, the feeding of the uppermost sheet S1 by the arcuate portion 21*a* of the feeding roller 21 is started.

When the uppermost sheet S1 is fed by the arcuate portion 21*a*, the uppermost sheet S1 is separated from other sheets by the separation pad 23. The sole uppermost sheet S1 separated by the separation pad 23 is guided to the sheet feeding path 25 curved upward at a position immediately after the feeding roller 21 by the separation pad 23. As illustrated in FIG. 5, when the sheet feeding path 25 is guided to the sheet feeding path 25, a leading edge of the uppermost sheet S1 abuts against the conveying guide 26 disposed on the sheet feeding path 25, and the uppermost sheet S1 is deflected by a feeding force of the feeding roller 21 and forms a loop. In this manner, the reason why the sheet S1 forms the loop is that the sheet feeding path 25 is curved immediately after the feeding roller 21 in order to reduce the size of the laser printer 1. As illustrated in FIG. 6, when the uppermost sheet S1 is further fed by the feeding roller 21, the uppermost sheet S1 moves (passes) along the conveying guide 26 in a state of being deflected, and is nipped by the conveying roller pair 24.

Here, the sheet conveyance speed of the conveying roller pair 24 is set to be higher than the sheet feeding speed of the feeding roller 21. Therefore, the loop of the uppermost sheet S1 nipped by the conveying roller pair 24 is gradually reduced in size due to the sheet conveyance speed difference between the feeding roller 21 and the conveying roller pair 24. Then, the loop of the uppermost sheet S1 is eliminated at a timing when the feeding of the uppermost sheet S1 by the arcuate portion 21*a* is terminated (see a broke line S1 illustrated in FIG. 6). As a result of elimination of the loop, the feeding roller 21 is pulled by the uppermost sheet S1 conveyed by the conveying roller pair 24. However, when the loop is eliminated, the arcuate portion 21*a* of the feeding roller 21 is away from the uppermost sheet S1, and the uppermost sheet S1 is in a state of being supported by the feeding rollers 22 which are rotated thereby. Therefore, since the loop of the uppermost sheet S1 is eliminated in a state in which the arcuate portion 21*a* is rotated by the uppermost sheet S1 being conveyed, generation of a burst sound generated when the sheet is pulled is prevented. Also application of an unnecessary load on the conveying roller pair 24 and the feeding roller 21 is prevented.

In contrast, as illustrated in FIG. 7, the leading edge of the uppermost sheet S1 fed by the feeding roller 21 may be conveyed to the downstream side of the nip between the feeding roller 21 and the separation pad 23 when the sheet feeding is started. If the sheet feeding is started from this state, the leading edge of the uppermost sheet S1 fed by the feeding roller 21 reaches the conveying roller pair 24 earlier than the preset time. Consequently, the period during which the feeding roller 21 (the arcuate portion 21*a*) and the conveying roller pair 24 convey the uppermost sheet S1 simultaneously becomes longer. Accordingly, the loop of the uppermost sheet S1 is eliminated before (while) the uppermost sheet S1 leaves the arcuate portion 21*a* of the feeding roller 21. Consequently, an unnecessary load may be applied to the conveying roller pair 24 and the feeding roller 21 by the arcuate portion 21*a* of the feeding roller 21 being pulled by the uppermost sheet S1.

However, the sheet feeding unit 2 of the first embodiment is provided with the ratchet mechanism 6 configured to release the coupling with the drive motor M so as to transmit the driving force when the arcuate portion 21*a* is pulled by the uppermost sheet S1 being conveyed by the conveying roller pair 24. In other words, when the arcuate portion 21*a* is pulled by the uppermost sheet S1, the ratchet mechanism 6 disconnects the drive shaft 61 and the shaft 62 and hence the rotation of the drive motor M is not transmitted to the feeding roller 21, whereby the arcuate portion 21*a* of the feeding roller 21 is rotated by the uppermost sheet S1. Therefore, since the feeding roller 21 is rotated by the uppermost sheet S1, application of an unnecessary load on the sheet S1 by the conveying roller pair 24 and the feeding roller 21 pulling the sheet S1 in the opposite directions is avoided, and hence the uneven abrasion and generation of the sound may be suppressed.

Furthermore, when the feeding roller 21 is stopped because the uppermost sheet S1 leaves the arcuate portion 21*a*, the ratchet mechanism 6 brings the drive shaft 61 and the shaft 62 into a coupled state again so that the feeding roller 21 is rotated thereby because the one-rotation control mechanism C rotates the drive shaft 61 so as to cause the feeding roller 21 to rotate 360 degrees. Accordingly, the feeding roller 21 is returned back to its home position.

The size of the loop formed when the sheet is conveyed in the sheet feeding path 25 may be smaller than the normal case due to the rigidity (resiliency) or the like of the sheet. In such a case, the loop of the uppermost sheet S1 is eliminated before the uppermost sheet S1 leaves the arcuate portion 21*a* of the feeding roller. Consequently, an unnecessary load may be applied to the conveying roller pair 24 and the feeding roller 21 by the arcuate portion 21*a* of the feeding roller 21 being pulled by the uppermost sheet S1. However, in the same manner as the configuration described above, the uppermost sheet may be fed without applying an unnecessary load to the conveying roller pair 24 and the feeding roller 21 and the arcuate portion 21*a* (feeding roller 21) may be returned back to its home position.

As described thus far, in the case of the laser printer 1 of the first embodiment, the sheet conveyance speed difference between the feeding roller 21 and the conveying roller pair 24 is set so that the loop of the sheet S is eliminated at a timing when the feeding of the sheet S by the arcuate portion 21*a* is terminated. Therefore, the loop of the sheet formed when being conveyed in the sheet feeding path 25 may be eliminated when the feeding of the sheet S by the arcuate portion 21*a* is terminated. Accordingly, generation of the burst sound or the like which may be generated to eliminate the loop when the feeding of the sheet S by the feeding roller 21 is terminated may be prevented.

The laser printer 1 of the first embodiment is provided with the ratchet mechanism 6 configured to stop the transmission of the driving force from the drive motor M when the arcuate portion 21*a* is pulled by the uppermost sheet S1 being conveyed by the conveying roller pair 24. Therefore, when the arcuate portion 21*a* is pulled by the uppermost sheet S1, the driving force transmitted from the drive motor M to the feeding roller 21 is stopped, and the arcuate portion 21*a* may be rotated by the sheets S1 prior to the drive motor M. Accordingly, application of an unnecessary load on the conveying roller pair 24 and the feeding roller 21 is prevented. Consequently, uneven abrasion or the like of the conveying roller pair 24 and the feeding roller 21 may be prevented.

Second Embodiment

Figure 8:
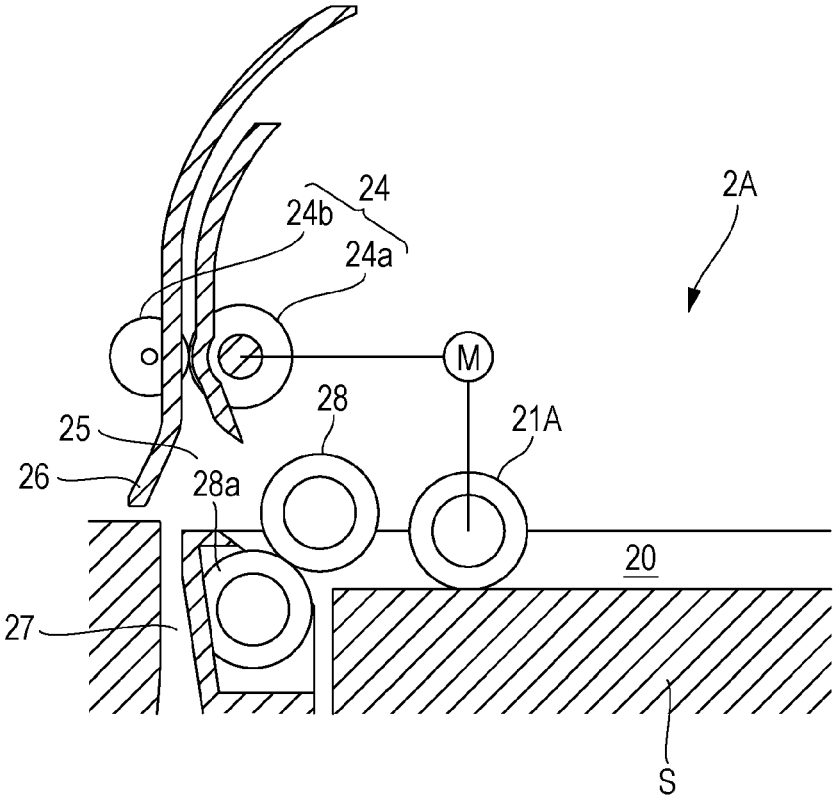
FIG. 8 is a partial enlarged cross-sectional view of a seat feeding unit of a second embodiment.
Figure 9:
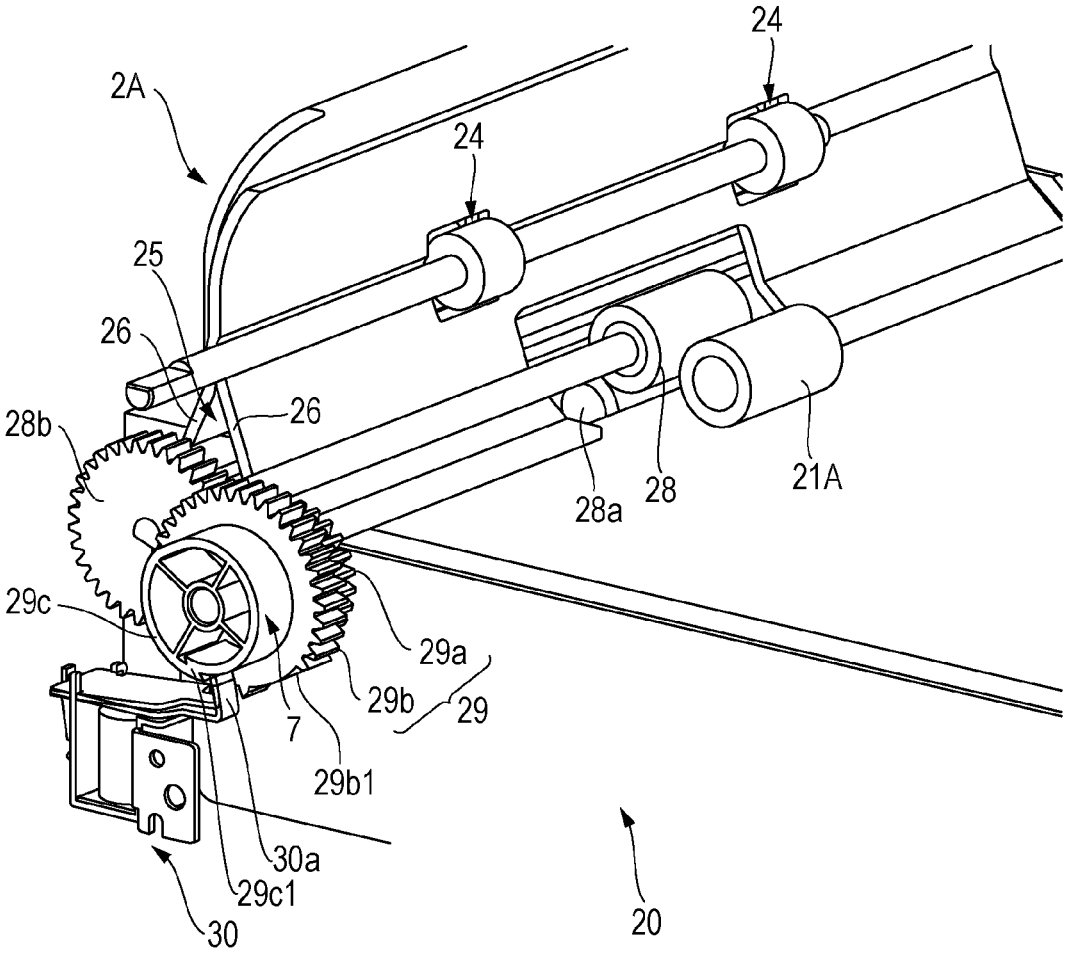
FIG. 9 is a perspective view illustrating part of the seat feeding unit of the second embodiment.
Figure 10:
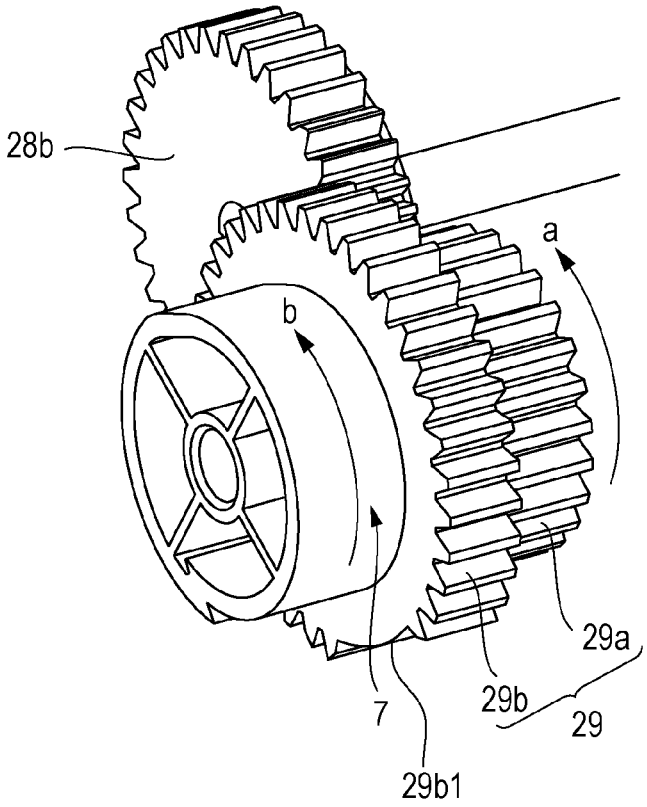
FIG. 10 is a perspective view illustrating a gear train having a one-way clutch mechanism illustrated in FIG. 9 integrated therein.

Referring now to FIG. 8 to FIG. 10, a laser printer 1A of a second embodiment of the disclosure will be described. The laser printer 1A of the second embodiment is different from that of the first embodiment in a one-direction rotation control mechanism of a sheet feeding unit. Therefore, in the second embodiment, a point different from the first embodiment, that is, the one-direction rotation control mechanism is mainly described, and the same configurations as the laser printer 1 of the first embodiment are denoted by the same reference numerals and description thereof is omitted.

FIG. 8 is a partial enlarged cross-sectional view illustrating a seat feeding unit 2A of the second embodiment. FIG. 9 is a perspective view illustrating part of the seat feeding unit 2A of the second embodiment. FIG. 10 is a perspective view illustrating a gear train (speed gear) 29 having a one-way clutch mechanism 7 illustrated in FIG. 9 integrated therein.

As illustrated in FIG. 8 and FIG. 9, the sheet feeding unit 2A of the second embodiment includes the feeding cassette 20, a feeding roller 21A, the drive motor M, a feed roller 28, a retard roller 28*a* rotated by the rotation of the feed roller 28, and the conveying roller pair 24. A driving force transmission mechanism 100 (see FIG. 2) configured to transmit the driving force from the drive motor M to the feeding roller 21A includes the one rotation control mechanism C configured to perform the one rotation control on the feeding roller 21A and the one-way clutch mechanism 7 as the one-way rotation control mechanism. The feeding roller 21A rotates upon transmission of the rotation from the drive shaft of the feed roller 28, and is rotated at the same sheet conveyance speed as that of the feed roller 28. The retard roller 28*a* is configured to separate the sheet at a nip portion with respect to the feed roller 28, and may have a configuration of being rotated via a torque limiter in the direction opposite to the sheet conveying direction or a configuration of being mounted on the apparatus via the torque limiter without using the driving force.

The feeding roller 21A and the feed roller 28 are formed into a substantially conical shape and are subjected to a one rotation control. The feed roller 28 receives the driving force transmitted from the drive motor M via the gear train 29 having the one-way clutch mechanism 7 integrated therein. The gear train 29 includes a first gear 29*a* connected to the drive shaft of the feed roller 28 and the second gear 29*b* connected to the rotational driving force transmission mechanism 100 configured to transmits the rotational driving force from the drive motor M. As illustrated in FIG. 10, the first gear 29*a* and the second gear 29*b* are coupled via the one-way clutch mechanism 7. The one-way clutch mechanism 7 transmits the rotation from the drive motor M in the direction of rotation b from the second gear 29*b* to the first gear 29*a*, but does not transmit the rotation in the direction of rotation a transmitted from the feed roller 28 from the first gear 29*a* to the second gear 29*b*. The directions of rotation a and b are the directions of rotation of the gear train 29 when the feed roller 28 rotates in the direction in which the sheet is fed. Since the one-way clutch mechanism 7 is the same as a general one-way clutch mechanism, description is omitted here.

In FIG. 9, reference numeral 30 denotes a solenoid, and a claw portion 30*a* thereof engages a shoulder portion 29*c*1 formed on a cylindrical portion 29*c* of the gear train 29 to restrict the rotation of the gear train 29 in the direction a illustrated in FIG. 10. The second gear 29*b* is provided with a tooth missing portion 29*b*1 having no tooth, and the driving force is not transmitted when the tooth missing portion 29*b*1 faces a drive gear, not illustrated, which receives the driving force transmitted from the drive motor M. When the rotation of the gear train 29 is restricted by the solenoid 30, the drive gear faces the tooth missing portion 29*b*1 of the second gear 29*b* and hence the driving force is not transmitted. When the solenoid 30 is excited and the claw portion 30*a* is moved away from the shoulder portion, the drive gear and the second gear 29*b* engage and the driving force is transmitted. When the gear train 29 rotates 360 degrees and the claw portion 30*a* of the solenoid 30 engages the shoulder portion, so that the gear train 29 stops and the transmission of the driving force is stopped. The feed roller 28 may be rotated 360 degrees by the 360-degree rotation of the gear train 29.

The feed roller 28 and the retard roller 28*a* are disposed downstream of the feeding roller 21A and, as described above, are configured to separate the sheets fed by the feeding roller 21A one by one. The feed roller 28 includes the feed roller gear 28*b* connected thereto and the feed roller gear 28*b* engages the first gear 29*a*. The feed roller 28 and the retard roller 28*a* constitute the sheet feeding path curved immediately after the feeding roller 21A so that the sheets S fed by the feeding roller 21A are fed upward. The sheet feeding path 25 is curved by the retard roller 28*a* upward from the downstream end portion of the feeding cassette 20, and then is guided toward the conveying roller pair 24 by the conveying guide 26.

The conveying roller pair 24 is set to be a sheet conveyance speed Vf which is higher than a sheet feeding speed Vp of the sheets S by the feed roller 28, and this speed relationship is set to cause the feeding roller 21A eliminates the loop of the sheet S described later during the one rotation control.

Subsequently, a sheet feeding operation performed by the sheet feeding unit 2A of the second embodiment will be described. When the feeding of the sheet S by the sheet feeding unit 2A is started in parallel to the toner image forming action described above, the elevating mechanism moves the sheet S stored in the feeding cassette 20 upward, and brings the uppermost sheet S1 to abut against the feeding roller 21A. When the solenoid 30 is excited and the claw portion 30*a* is moved away from the shoulder portion, the driving force from the drive motor M is transmitted to the feed roller 28 and the feeding roller 21A. When the one rotation control of the feeding roller 21A and the feed roller 28 is started by the rotation control performed by the one rotation control mechanism C, the uppermost sheet S1 is started to be fed by the feeding roller 21A.

When the uppermost sheet S1 is fed by the feeding roller 21A, the uppermost sheet S1 is separated from other sheets by the feed roller 28 and the retard roller 28*a* first, so that duplicated feeding of the sheets S is prevented. The uppermost sheet S1 separated from other sheets by the feed roller 28 and the retard roller 28*a* is guided by the sheet feeding path 25 curved upward immediately after the feed roller 28. When the sheet feeding path 25 is guided, the leading edge of the uppermost sheet S1 abuts against the conveying guide 26 disposed on the sheet feeding path 25, and the uppermost sheet S1 is deflected by a feeding force of the feeding roller 21A and forms a loop. When the uppermost sheet S1 is further fed by the feeding roller 21A, the uppermost sheet S1 moves along the conveying guide 26 in the deflected state and is nipped by the conveying roller pair 24.

Here, the sheet conveyance speed of the conveying roller pair 24 is set to be higher than the sheet feeding speeds of the feeding roller 21A and the feed roller 28. Therefore, the loop of the uppermost sheet S1 nipped by the conveying roller pair 24 is gradually reduced in size due to the sheet conveyance speed difference of the feeding roller 21A and the feed roller 28 with respect to the conveying roller pair 24. Then, the loop of the uppermost sheet S1 is eliminated at a timing when the one rotation control of the feed roller 28 is terminated. Therefore, the loop is eliminated in a circumstance in which a backward tension is applied to the conveying roller pair 24 due to the termination of the one rotation control, and hence a burst sound generated when the sheet is pulled is prevented. Also application of an unnecessary load on the feeding roller 21A and the feed roller 28 is prevented.

In contrast, the leading edge of the uppermost sheet S1 fed by the feeding roller 21A may be conveyed to the downstream side of the nip between the feed roller 28 and the retard roller 28*a* when the sheet feeding is started. If the sheet feeding is started from this state, the leading edge of the uppermost sheet S1 fed by the feeding roller 21A reaches the conveying roller pair 24 earlier than the preset timing. Consequently, the period during which the feeding roller 21A, the feed roller 28, and the conveying roller pair 24 convey the uppermost sheet S1 simultaneously becomes longer. Accordingly, the loop of the uppermost sheet S1 is eliminated before the termination of the one rotation control of the feeding roller 21A. Consequently, an unnecessary load may be applied to the conveying roller pair 24, the feeding roller 21A and the feed roller 28 by the feeding roller 21A and the feed roller 28 being pulled by the uppermost sheet S1.

However, the sheet feeding unit 2A of the second embodiment is provided with the one-way clutch mechanism 7 configured to stop the transmission of the driving force from the drive motor M when the feeding roller 21A and/or the feed roller 28 is/are pulled by the uppermost sheet S1 being conveyed by the conveying roller pair 24. Therefore, when the feeding roller 21A and/or the feed roller 28 is/are pulled by the uppermost sheet S1, the one-way clutch mechanism 7 stops the driving force transmitted from the drive motor M to the feeding roller 21A. Then, the feeding roller 21A and the feed roller 28 are rotated by the uppermost sheet S1. Accordingly, application of an unnecessary load on the conveying roller pair 24, the feeding roller 21A, and the feed roller 28 is prevented. Consequently, uneven abrasion or the like of the conveying roller pair 24, the feeding roller 21A, and the feed roller 28 may be prevented and stable sheet feeding is enabled.

Third Embodiment

Referring now to FIGS. 11A, 11B and FIGS. 12A and 12B, a laser printer 1B according to a second embodiment will be described. The laser printer 1B of the third embodiment is different from that of the first embodiment in the one-direction rotation control mechanism. Therefore, in the third embodiment, a point different from the first embodiment, that is, the one-direction rotation control mechanism is mainly described, and the same configurations as the laser printer 1 of the first embodiment are denoted by the same reference numerals and description thereof is omitted.

Figure 11A:
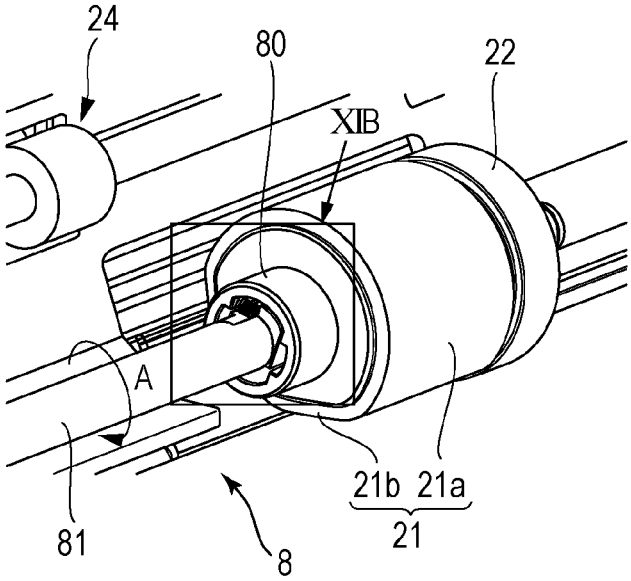
FIG. 11A is a perspective view illustrating a play mechanism of a sheet feeding unit of a third embodiment.
Figure 11B:
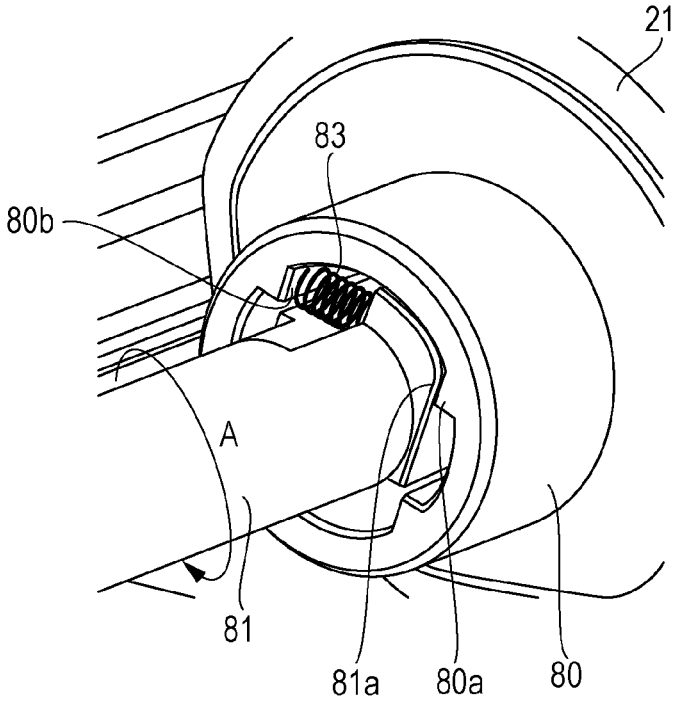
FIG. 11B is a partial enlarged view of a part XIB in FIG. 11A.
Figure 12A:
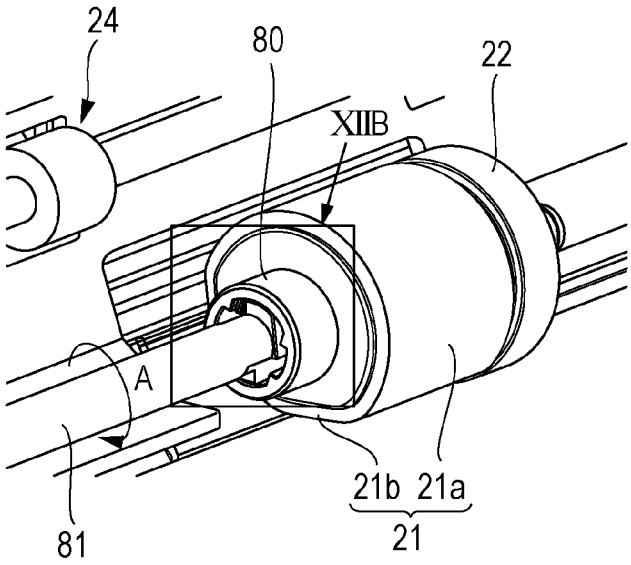
FIG. 12A is a perspective view illustrating a state in which an urging spring of the play mechanism illustrated in FIG. 11A is completely contracted.
Figure 12B:
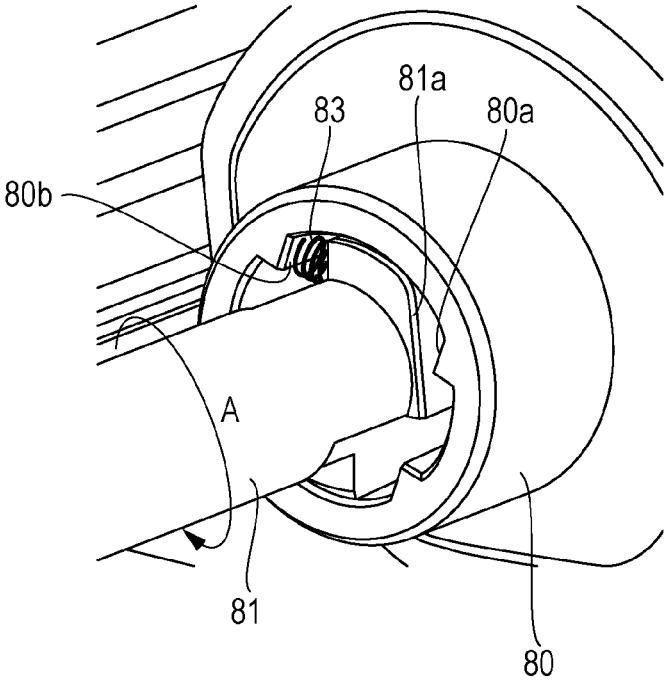
FIG. 12B is a partial enlarged view of a part XIIB in FIG. 12A.

FIG. 11A is a perspective view illustrating a play mechanism 8 of a sheet feeding unit 2B of the third embodiment. FIG. 11B is a partial enlarged view of a part XIB in FIG. 11A. FIG. 12A is a perspective view illustrating a state in which an urging spring of the play mechanism 8 illustrated in FIG. 11A is completely contracted. FIG. 12B is a partial enlarged view of a part XIIB in FIG. 12A.

The sheet feeding unit 2B of the third embodiment includes the feeding cassette 20, the feeding roller 21, the drive motor M, the driving force transmission mechanism 100 configured to transmit the driving force from the drive motor M to the feeding roller 21, the feeding rollers 22, the separation pad 23, and the conveying roller pair 24. The driving force transmission mechanism 100 includes the one rotation control mechanism C configured to perform the one rotation control on the feeding roller 21 and the play mechanism 8 as the one-way rotation control mechanism.

The play mechanism 8 is interposed between the feeding roller 21 and a drive shaft 81, and when the feeding roller 21 to be subjected to the one rotation control is pulled by the sheet S, the transmission of the driving force from the drive motor M is stopped and the feeding roller 21 is caused to be rotated by the sheet S by a predetermined angle. As illustrated in FIGS. 11A and 11B, the play mechanism 8 is disposed coaxially with the feeding roller 21 in the interior of the feeding roller 21, and includes a feeding roller core 80, the drive shaft 81 to which the driving force is transmitted from the drive motor M, and an urging spring 83 interposed between the feeding roller core 80 and the drive shaft 81.

The feeding roller core 80 fixedly supports the feeding roller 21 and is supported so as to be rotatable with respect to the printer body 10, whereby the feeding roller 21 is rotatably supported by the printer body 10. The feeding roller core 80 rotatably supports the feeding rollers 22 disposed on the both sides of the feeding roller 21. A first engaged portion 80*a* and a second engaged portion 80*b* are formed in the interior of the feeding roller core 80, and the first engaged portion 80*a* and the second engaged portion 80*b* are formed away from each other by a predetermined angle of rotation.

The drive shaft 81 receives at one end portion thereof the driving force transmitted from the drive motor M, and is formed at the other end portion thereof with an engaging portion 81*a* engageable with the first engaged portion 80*a* and the second engaged portion 80*b*. The engaging portion 81*a* is formed so as to be positioned between the first engaged portion 80*a* and the second engaged portion 80*b*.

The urging spring 83 is interposed between the second engaged portion 80*b* and the engaging portion 81*a*, and is configured to urge the engaging portion 81*a* to engage the engaging portion 81*a* with the first engaged portion 80*a*. As illustrated in FIGS. 12A and 12B, an urging force of the urged spring 83 is set to an urging force which allows the engaging portion 81*a* to move away from the first engaged portion 80*a* when the feeding roller 21 is pulled by the sheet S and the feeding roller 21 rotates in the direction of feeding rotation A at an angular rotational speed higher than that of the drive shaft 81.

Subsequently, a sheet feeding operation performed by the sheet feeding unit 2B of the third embodiment will be described. Since the normal sheet feeding action is the same as that of the first embodiment, only a case where the leading edge of the uppermost sheet S1 fed by the feeding roller 21 is conveyed to the downstream side of the nip between the feeding roller 21 and the separation pad 23 when the sheet feeding is started will be described.

When the sheet feeding is started in a state in which the leading edge of the uppermost sheet S1 is conveyed to the downstream side of the nip between the feeding roller 21 and the separation pad 23, the uppermost sheet S1 fed by the feeding roller 21 reaches the conveying roller pair 24 early. Consequently, the period during which the feeding roller 21 (the arcuate portion 21*a*) and the conveying roller pair 24 convey the uppermost sheet S1 simultaneously becomes longer. Accordingly, the loop of the uppermost sheet S1 is eliminated before the uppermost sheet S1 leaves the arcuate portion 21*a* of the feeding roller 21. Consequently, an unnecessary load may be applied to the conveying roller pair 24 and the feeding roller 21 by the arcuate portion 21*a* of the feeding roller 21 being pulled by the uppermost sheet S1.

However, in the sheet feeding unit 2B of the third embodiment, when the arcuate portion 21*a* is pulled by the uppermost sheet S1 being conveyed by the conveying roller pair 24, the engaging portion 81*a* moves away from the first engaged portion 80*a* against the urging fore of the urging spring 83. Accordingly, the driving force transmission between the drive shaft 81 which receives the driving force transmitted from the drive motor M and the feeding roller 21 is stopped. In this manner, in the third embodiment, the urging spring 83 is compressed to prevent an unnecessary load from being applied to the conveying roller pair 24 and the feeding roller 21. Consequently, uneven abrasion or the like of the conveying roller pair 24, the feeding roller 21A, and the feed roller 28 may be prevented and stable sheet feeding is enabled.

Although the embodiments of the invention have been described thus far, the invention is not limited to the embodiments described above. The advantages of the invention described in the embodiments are only a list of most preferable advantages generated by the invention, and the advantages of the invention are not limited to those described in the embodiments of the invention.

For example, the feeding roller 21 and the conveying roller pair 24 are configured to be driven by the single drive motor M in the embodiments described above. However, the invention is not limited thereto. For another example, the feeding roller 21 and the conveying roller pair 24 may be configured to be driven separately by individual drive motors. In this case, for example, there is a case where the size of the loop formed by the sheet S varies depending on the rigidity of the sheet S. However, by driving the feeding roller 21 and the conveying roller pair 24 with the individual drive motors, setting the sheet conveyance speed difference according to the rigidity of the sheet is enabled.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-044511, filed in Feb. 29, 2012, which is hereby incorporated by reference herein in its entirety.

What is claimed is:

1. A sheet feeding unit comprising:

a feeding roller that is formed into a non-circular shape, and includes an arcuate portion to feed a sheet and a notched portion cut out part;

a drive motor configured to drive the feeding roller;

a driving force transmission mechanism configured to transmit a driving force from the drive motor to the feeding roller;

a one rotation control mechanism, provided in the driving force transmission mechanism, configured to control the rotation of the feeding roller;

a curved sheet feeding path downstream of the feeding roller in the sheet feeding direction;

a conveying roller, provided downstream of the curved sheet feeding path, configured to receive and convey the sheet fed from the feeding roller and to be set to a sheet conveyance speed greater than that of the feeding roller to eliminate a loop formed when the sheet fed by the feeding roller is passing through the sheet feeding path during the one rotation control of the feeding roller by the one rotation control mechanism; and a one-way rotation control mechanism configured to stop the transmission of the driving force from the drive motor to the feeding roller in the case that the arcuate portion of the feeding roller is pulled by the sheet being conveyed by the conveying roller in the course of the one rotation control of the feeding roller, and to cause the drive motor to be coupled again with the feed roller to transmit the driving force and perform the one rotation control on the feeding roller after the arcuate portion which is rotated by the sheet leaves the sheet and hence the feeding roller is stopped.

2. The sheet feeding unit according to claim 1, wherein the one-way rotation control mechanism includes:

a drive shaft having an engaging portion and configured to rotate upon reception of the driving force from the drive motor;

a shaft having an engaged portion engageable with the engaging portion and connected to the feeding roller; and an urging device configured to urge the shaft toward the drive shaft to cause the engaging portion to be engaged with the engaged portion, wherein when the feeding roller is pulled by the sheet being conveyed by the conveying roller, an engagement between the engaging portion and the engaged portion is released against an urging force of the urging device to stop the transmission of the driving force from the drive motor to the feeding roller.

3. An image forming apparatus comprising:

the sheet feeding unit according to claim 1; and an image forming unit configured to form an image on a sheet fed by the sheet feeding unit.

4. The sheet feeding unit according to claim 1, wherein the one-way rotation control mechanism includes:

a drive shaft having an engaging portion and configured to rotate upon reception of the driving force from the drive motor;

an engaged portion, provided on the feeding roller, engageable with the engaging portion; and an urging device, provided between the drive shaft and the feeding roller, configured to engage the engaging portion and the engaged portion, wherein when the feeding roller is pulled by the sheet being conveyed by the conveying roller, an engagement between the engaging portion and the engaged portion is released against an urging force of the urging device to stop the transmission of the driving force from the drive motor to the feeding roller.

5. An image forming apparatus comprising:

the sheet feeding unit according to claim 4; and an image forming unit configured to form an image on a sheet fed by the sheet feeding unit.

* * * * *